US005865681A

United States Patent [19]

Tudek et al.

[11] Patent Number: 5,865,681

[45] Date of Patent: Feb. 2, 1999

[54] CUE-PUTT-TOSS BALL GAME TABLE

[76] Inventors: Arthur Leonard Tudek; Arthur Paul Tudek, both of 507 Indiana Ave., Glassport, Pa. 15045

[21] Appl. No.: 985,455

[22] Filed: Dec. 5, 1997

[51] Int. Cl.[6] ..... A63D 15/04

[52] U.S. Cl. ..... 473/15

[58] Field of Search ..... 473/4, 10, 12, 473/15, 157; 273/309, 118 R

[56] References Cited

U.S. PATENT DOCUMENTS

| | | | |
|---|---|---|---|
| 1,269,614 | 6/1918 | Lapp | 473/15 |
| 2,418,514 | 4/1947 | Lamberson | 273/309 |
| 3,591,176 | 7/1971 | Roth | 473/15 X |
| 3,889,945 | 6/1975 | Ellis | 473/15 |
| 5,020,799 | 6/1991 | Chang | 473/15 |

*Primary Examiner*—William E. Stoll

[57] ABSTRACT

This present invention is a ball game table comprising two flat, long narrow boards joined together to make one flat, long narrow board with folding or retractable leg units secured at the underside. The purpose of the folding legs is to provide two different playing modes. The first is in the upright position with the legs vertical and the second is the legs are retracted and the table lies flat on the ground as a platform. The top surface is completely covered with a fabric such as grass carpeting at the longitudinal dimension and a few inches shorter at the breadth side with objective markings at each end. Quarter round molding surrounds the perimeter of the surface, serving as a gutter. Also at ends of the table are recessed boxes attached to corral and contain the balls on the table. Extending over both longitudinal edges of the board, at the center, is a small square extension also covered with the fabric with 2¼" diameter hole.

9 Claims, 3 Drawing Sheets

CUE-PUTT-TOSS BALL GAME TABLE

BRIEF SUMMARY OF THE INVENTION

This invention is a construction of a ball game table that has two different operational or playing modes. In the first mode with the legs up in a vertical position, billiard balls can be cued by a player with a cue stick or hand tossed toward the opposite end of said table to certain lined areas or the extended hole on this unique ball game table. The other mode can be accomplished by retracting or folding the legs inwardly in a horizontal position resulting in the said table lying flat on the ground to provide a player a surface to stand on or along side to putt golf balls with a golf putter or toss other balls likewise to the opposite end toward lined areas or a hole to score points providing competitive and exciting games.

BACKGROUND OF THE INVENTION

This invention relates to improvements in a game table in which a game vaguely similar to shuffleboard may be played with billiard balls, cue sticks, golf balls, golf putters or tossing balls on a level, cushioned surface toward the opposite end of said game table to score points within designated lined areas or a single hole.

While the present invention resembles a shuffleboard table, it is distinctly different in many and major facets. The patent of Stokes, U.S. Pat. No. 4,229,004 shows a floor type apparatus only, with shape, size and objectives being distinctly different. As is Hall's game table of U.S. Pat. No. 4,989,863 which he reveals a standing ball game table only, also with different shape, size and other features and objectives different. This present ball game table has the ability to do both phases of standing or lying on the ground to perform various games.

SUMMARY OF THE INVENTION

The principal object of this present invention is to provide a ball game table with folding legs utilized as a means to play various ball games in two different modes. In the first mode, with the legs extended vertically, billiard balls can be cued with a cue stick or tossed by players in a standing position toward lined areas or a hole at the opposite end to score points. The other mode is when the legs are folded inwardly resulting in the said table to lie flat on the ground permitting a player to stand on or along side to putt golf balls with a golf putter or toss other balls from a stooped position to accomplish their objectives.

Another object is the provision of a ball game table wherein the playing surface is a construction of two flat, long narrow boards joined together (easily unjoined when needed for moving or transporting) atop an apron with a plurality of cross members to provide a longer game table with a carpet covering, shorter on the breadth sides and a quarter round molding enveloping the perimeter to provide a gutter means.

A further object on this conbination ball game table is to provide two grasp handles on each side of the apron to enable a person to gently upset the said table on its side to retract the legs inwardly then lower it to the ground to lie flat or lift said table on its side to extend the legs and lift the table to a standing position.

Still another object is the provision of a ball game table wherein the scoring is provided with perpendicular area lines and a hole provided by means of a square, carpeted covered extension at the end and in the center of the playing surface.

Yet another object is the provision of cross member levelers, the nomenclature being a short piece of round pipe filled with cement after an all-thread, hexagon head bolt is centered and extended within said pipe to be hand screwed into the cross members at weight bearing points to level said table.

These and other objects and advantages will be apparent as the specification is considered with accompaying drawings.

DETAILED DESCRIPTION

Figure 1:
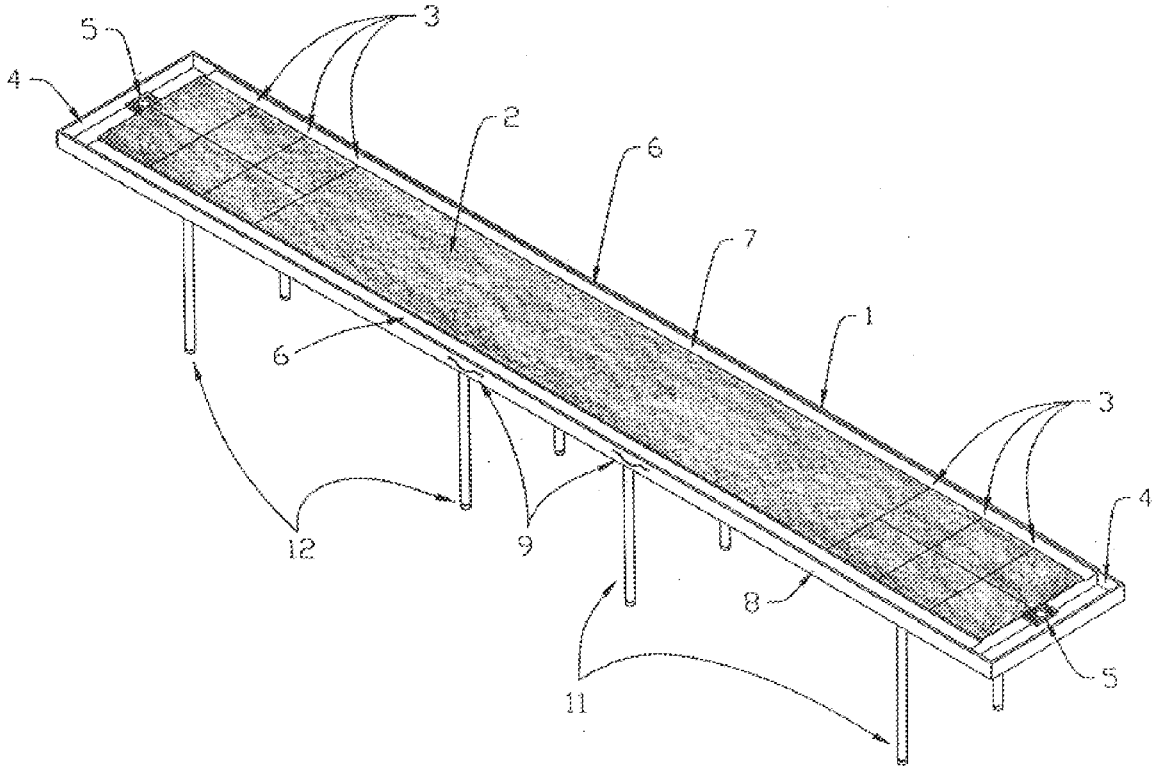
FIG. 1 is a perspective view where the legs are extended vertically and the table is in an upright position in the pool-cue mode.

Referring more particularly to the drawings, as best shown in FIG. 1, shows the table embodying the invention of which the playing surface is a flat, long narrow board 1 where a sheet of carpeting 2 (shaded) is layed over the entire longitudinal plane and a few inches shorter at the breadth side of the narrow board 1. Upon the sheet 2 at each end of the narrow board 1 are perpendicular lines 3 for point scoring. Also at each end of the narrow board 1 are fabric lined, recessed boxes 4 to catch and contain the balls. At the edges of the longitudinal ends of the narrow baord 1 and in the center of the recessed boxes 4 are fabric covered, extended squares 5 with holes, also for scoring. Enveloping the entire perimeter of table is quarter round molding 6 to serve as a containment gutter 7. Underneath the narrow board 1 at the longitudinal plane is the apron 8. Near the center of said table, connected to the apron 8 are grasp handles 9 to upset or upright the table. Secured to the underside of the narrow board 1 are the folding legs 11 with stability shoes 12 under them.

Figure 2:
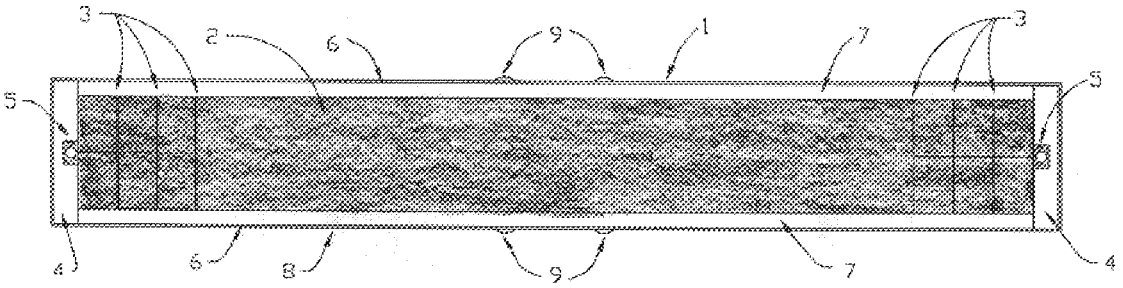
FIG. 2 is a top view where the legs are folded away as the table lies flatly on the ground in the golf-putt mode.

FIG. 2 shows the sheet of carpeting 2 (shaded) with the perpendicular lines 3 painted on said sheet 2. At each end of the table are recessed boxes 4. In the center and above the recessed boxes 4 are extended squares 5 with holes. Enveloping the entire perimeter of table is the quarter round molding 6 to serve as a containment for the gutter 7. Near the center of table, connected to the apron 8 are the grasp handles 9.

Figure 3:
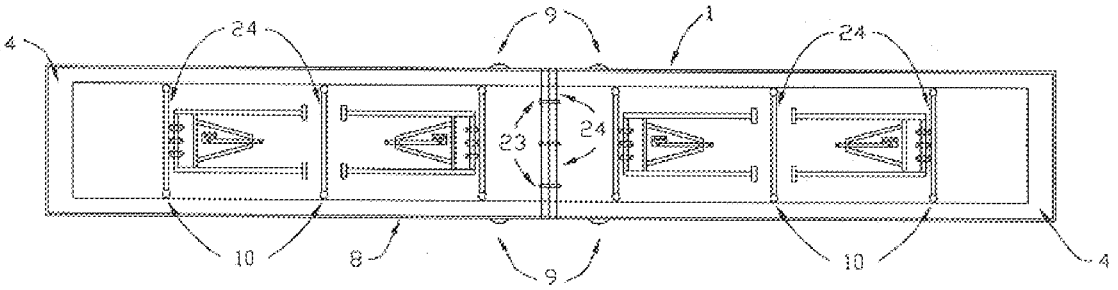
FIG. 3 is a plan view of the underside of game table.
Figure 4:
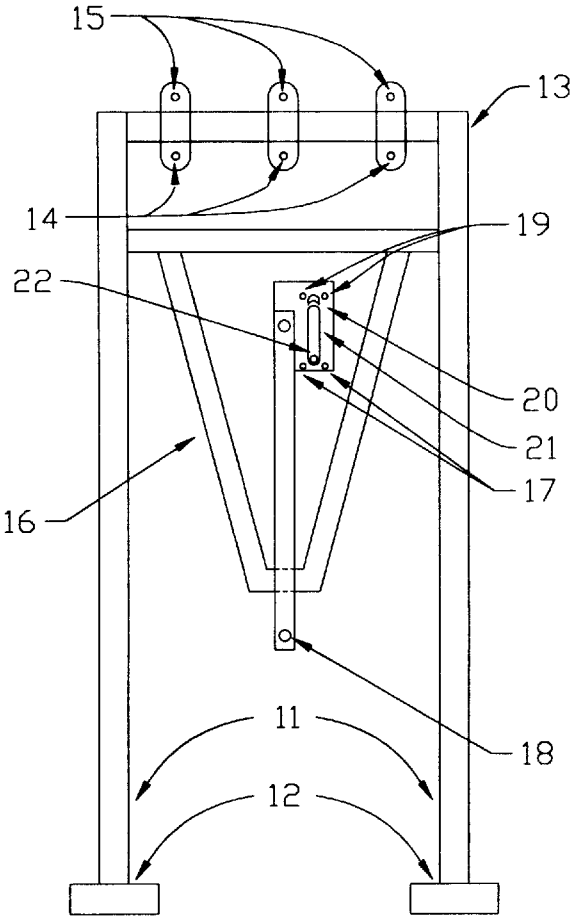
FIG. 4 is an enlarged view of the folding leg assembly.

FIG. 3 shows the underside of the invention with the four folding leg assemblies shown but the parts are not identified, however the nomenclature is identified in an enlarged view of a single leg assembly in FIG. 4. Also at the underside in FIG. 3 is the apron 8 with grasp handles 9 attached to said apron 8. Also provided and attached to the said apron 8 are the perpendicular cross members 24 with the levelers 10 screwed into said cross members 24. At each end of the table are three nuts, bolts and washer assembly 23 securing two cross members 24 together resulting in joining the halves of the long narrow board 1.

FIG. 4 shows an enlarged, single folding leg assembly consisting of the folding legs 11, round pivot bar 13 secured by three metal straps 14 secured by two each screws 15. Each leg 11 is connected to a triangular shaped, pivoting-sliding assembly 16 of which the apex of said assembly 16 slides within the slightly raised containment bar 17 secured by two containment screws 18. Situated within the triangular shaped assembly 16 is a spring loaded, locking and release unit with four base screws 19, spring 20, catch 21 and a finger release 22. Underneath the legs 11 are stability shoes 12.

Figure 5:
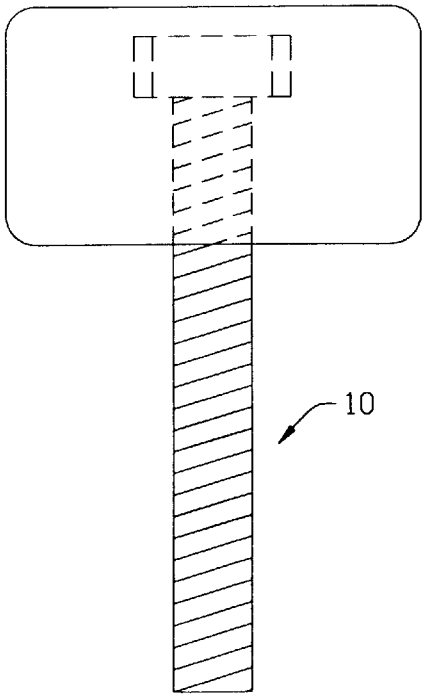
FIG. 5 is an enlarged, cut-away view of a cross member leveler.

FIG. 5 is an enlarged, cut-away view of leveler 10.

Having described the game apparatus, a typical game may be played therein is set forth below: The game can be played by two or four players as in horseshoes or shuffleboard. Each player takes a turn to compete. Be it with the table in an upright position, using pool sticks or tossing same balls toward the opposite end of the table to score points or when the table is in the down position using golf putters or tossing balls toward the opposite end of the table. The scoring is achieved this way: There are four areas of scoring. At each end of the table are three perpendicularly marked sections, 1 point, 2 points and a 3 point section nearest the end. The fourth area of scoring is the extended hole. That hole is four point score. Now a player tries to cue, putt or toss (whichever mode is being played) to come the closest to the longitudinal edge of table or into the hole. After each player in turn executes his or her three designated colored balls, the ball or balls that lie closest to the edge are the ones that are counted, similar to shuffleboard scoring. A ball that goes into the extended hole scores four points. If a player holes the extended hole after the opposing player achieved the hole, the first four points are cancelled and the latter player scores the four points and can accumulate more four pointers by accomplishing the hole again. Exactly 21 points wins the game. The player who goes over the 21 game goal, reverts back to 17 points and must go on to score the exact 21 points to win the game.

While a preferred embodiement of a ball game table that provides a means for players of golf, pool or Boche to play and enjoy their respective games, it is to be understood that various changes and improvements may be made therein without departing from the scope and spirit of the appended claims.

We claim:

1. A ball game table comprising:

a table apron;

a table top consisting of two long, flat narrow boards joined together to make a longer, flat narrow board fixed to said apron and a plurality of cross members attached perpendicularly to said table top;

a playing surface of a fabric such as grass carpeting completely covering the longitudinal dimension and a few inches shorter in breadth than the table top with a quarter round molding surrounding said table top to provide a gutter means.

2. A ball game table as claimed in claim 1, wherein said table has a plurality of folding leg assemblies attached to the underside for the purpose of utilizing said game table for two different operational or playing modes, the first with legs extended in a vertical position, billiard balls can be cued with a cue stick or same balls tossed toward the opposite end of said table to score points to make it a competitive game; the other mode is when the legs are folded inwardly allowing said table to lie flat on the ground as a platform providing a playing surface for a player to stand on or aside of said platform to putt golf balls with a golf putter or toss other balls toward the opposite end also to score points.

3. A ball game table as claimed in claim 1, wherein said grass carpeting has three perpendicular lines, spaced equally apart to designate an area for scoring 1, 2 or 3 points respectively.

4. A ball game table as claimed in claim 1, wherein a small wood square with a hole, also covered with carpet fabric is attached at the edge and in the center at both ends of said playing surface.

5. A ball game table as claimed in claim 1, wherein recessed boxes also lined with grass carpeting are provided at both ends of said playing surface to catch and contain the balls.

6. A ball game table as claimed in claim 1, wherein two grasp handles are provided on each side and attached to the apron at the center cross members to enable a person to gently upset or lift said table into desired mode.

7. A ball game table as claimed in claim 1, wherein said table can be assembled or disassembled at the middle of said table by means of nuts, bolts and washer assembly for the purpose of moving or transporting.

8. A ball game table as claimed in claim 1, wherein the playing surface fabric is prepared for adhesion to the long narrow board by applying masking tape over said board then spread carpet adhesive over the masking tape then applying the carpeting over the adhesive resulting in a firm adhesion with a clean and easy peel.

9. A ball game table as claimed in claim 1, wherein a plurality of cross member levelers are provided, consisting of a small piece of round pipe filled with a cement after an all-thread hexagon bolt is placed in the center and extending said pipe to be hand-screwed into the cross members to level the platform.

* * * * *